United States Patent [19]

Schmidt et al.

[11] Patent Number: 4,506,859

[45] Date of Patent: Mar. 26, 1985

[54] DEVICE FOR CONTROLLING A CONNECTION BETWEEN A PRESSURE MEDIUM SOURCE AND A FLUID SUPPLY CONTAINER IN A PRESSURE MEDIUM OPERATED SYSTEM

[75] Inventors: Hubertus Schmidt, Lohr; Norbert Mucheyer, Rechtenbach, both of Fed. Rep. of Germany

[73] Assignee: Mannesmann Rexroth GmbH, Lohr, Fed. Rep. of Germany

[21] Appl. No.: 471,148

[22] Filed: Mar. 1, 1983

[30] Foreign Application Priority Data

Mar. 12, 1982 [DE] Fed. Rep. of Germany ..... 3209014
Nov. 23, 1982 [DE] Fed. Rep. of Germany ..... 3243182

[51] Int. Cl.[3] ..... F16K 31/143
[52] U.S. Cl. ..... 251/63; 251/120; 251/210
[58] Field of Search ..... 251/63, 120, 122, 210; 137/115

[56] References Cited

U.S. PATENT DOCUMENTS

| | | | |
|---|---|---|---|
| 3,509,880 | 5/1950 | Pelton | 251/63 |
| 3,955,396 | 5/1976 | Carrieri | 137/115 |
| 4,353,385 | 10/1982 | Maisch et al. | 137/510 |
| 4,378,335 | 3/1983 | Boden et al. | 251/63 |
| 4,417,601 | 11/1983 | Bennett | 251/122 |

*Primary Examiner*—Carroll B. Dority, Jr.
*Attorney, Agent, or Firm*—Michael J. Striker

[57] ABSTRACT

A device for controlling the connection between a pressure medium source and a medium supply container is provided in a pressure medium operated system. The device includes a control valve with a housing formed with a longitudinal bore, in which a valve member is axially displaced between two end positions by pressure of the pressure medium. The valve member includes a piston and a seat portion facing a valve seat formed in the valve housing. The piston is of the diameter larger than that of the valve seat. A bore connected to the medium supply container is provided in the valve housing which is controlled by displacement of the piston.

8 Claims, 8 Drawing Figures

DEVICE FOR CONTROLLING A CONNECTION BETWEEN A PRESSURE MEDIUM SOURCE AND A FLUID SUPPLY CONTAINER IN A PRESSURE MEDIUM OPERATED SYSTEM

BACKGROUND OF THE INVENTION

The present invention relates to pressure medium operated systems in general, and more particularly to devices employed in those systems for controlling the connection between a pressure medium source, such as a pump, and a fluid supply container to which the pressure medium is conveyed.

In a conventional device of the type under discussion, a direct controllable pressure limiting valve is provided, including a valve member with a piston formed at the side thereof facing the valve seat, the piston being loaded with limited pressure of the pressure medium at its front face. A spring is normally clamped between the valve member and the valve housing at the side thereof facing away from the valve seat. One such valve is described in the publication "Öl-Hydraulik Fibel" by Dieter, Krausskopf Verlag, Wiesbaden, 1960, page 179.

SUMMARY OF THE INVENTION

It is an object of the invention to provide an improved device for controlling the connection between the pressure medium source and the medium supply container.

It is another object of the invention to provide an independent and reliable switching device with the valve member which operates to take one or two control end positions.

These and other objects of the invention are attained by a device for controlling a connection between a pressure medium source and a pressure medium supply container in a pressure medium operated system, comprising a control valve including a valve housing and a valve member having an axis, said valve member being axially displaceable in said housing by pressure of said medium, said housing having a valve seat, said valve member being formed with a piston and a seat portion projecting outwardly from said piston and facing said valve seat, said piston facing from said valve seat and being of a diameter larger than a diameter of the valve seat, said housing being formed with a connection bore connected to the supply container and provided at the side of said piston facing towards said seat portion, said piston during said displacement controlling an opening and a closing of said bore, said valve member at the side thereof facing away from said seat portion being loaded by the pressure medium by selection.

The valve member is adapted to move in its totally closed position or its totally open position in dependence upon the pressure prevailing at its side distant of its seat portion, which means that the connection between the pressure medium source, which is a pump, and the pressure medium supply container is either totally ceased or blocked through the device according to the invention or totally open and a suitable device, for example a pressure compensator or the like, can be switched in between the device of the invention and the pressure medium source. Thereby a required plain pressure ratio can be obtained in the control conduit leading from the device of the invention. The valve member performs in a corresponding change-over a quick switching movement and acts in a bistable interval stage. The switching pressure differential is freely selected by respective selection of the diameters of the valve seat and the piston of the valve member.

The device may be provided with throttle means, said throttle means being formed at the side of the piston facing toward the seat portion. Thereby an impact-like opening of the valve member can be possible because pressure medium flowing through the valve seat is initially built up in the throttle means.

The throttle means may be formed between a projection provided on the valve member and extended between said seat portion and said piston and a wall of said housing, said projection being of a diameter smaller than that of said piston.

Alternatively the throttle means may be formed by a throttle opening formed in a collar provided between the piston and the seat portion.

The buildup of the pressure in the valve housing in the space formed between the seat portion of the valve member and the piston is prevented.

The device may further include a switchable pressure compensator arranged in the pressure medium operated system and interconnected between the pressure medium source and the valve housing in the region of said seat portion to convey the pressure medium to the side of the pressure member facing said seat portion.

The device may further include additional throttle means arranged in the pressure medium operated system, said additional throttle means being interconnected between the pressure medium source and an inlet bore in the valve housing whereby the side of the valve member facing away from the seat portion is constantly connected to the pressure medium source through the additional throttle means.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
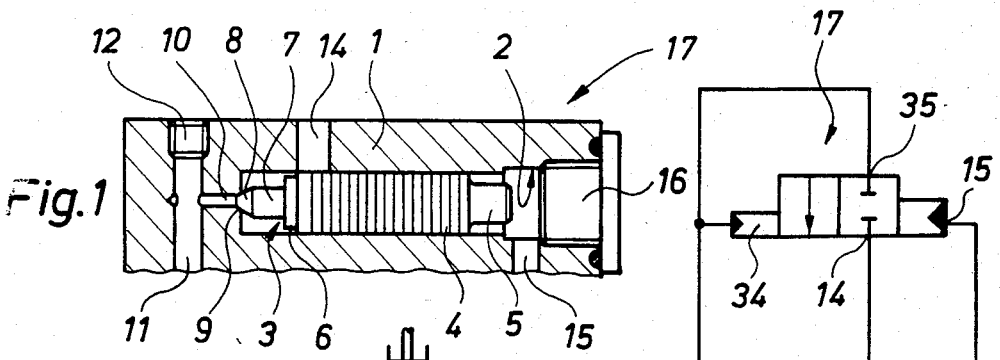
FIG. 1 is an axial sectional view of the valve of the first embodiment of the invention.

Referring now to the drawing, and first to FIG. 1, the control valve includes a valve housing 1 which is formed with a pocket opening denoted as 2 in which a valve member generally designated as 3 is positioned, which member is axially displaceable. The valve member 3 includes a piston 4 which has at its right side (in the plane of the drawing) an axial projection 5 and at its opposite side a throttle portion 6 which is also formed as a projection. Throttle portion 6 has an outer diameter which is somewhat smaller than that of the piston 4. Throttle portion 6 merges into a projection 7 which is terminated with a frustoconical seat portion 8 of the diameter substantially smaller than that of piston 4. The conical tip of seat portion 8 faces away from piston 4. The seat portion 8 cooperates with a valve seat 9 provided in the housing 1. The valve seat 9 is associated with an axial bore 10 which is coaxial with the pocket opening 2 and is in communication with a transversal bore 11 which in turn is closed at its one end with a closure screw 12.

The valve housing 1 is further formed with a connection bore 14 connected to a fluid supply container 13. Bore 14 is arranged against the piston 4 such that a throttle-like passage is formed between the throttle portion 6 adjacent the front edge of piston 4 and the wall of the connection bore 14 when the seat portion 8 is against valve seat 9, thereby no pressure is built up in the space lodging the projection 7.

The valve housing 1 is further provided in the region of projection 5 with a lateral connection bore 15. The pocket opening 2 is closed in the region of bore 15 with a screw 16. The control valve of the invention is designated in FIGS. 1 and 2 with a reference character 17.

Figure 2:
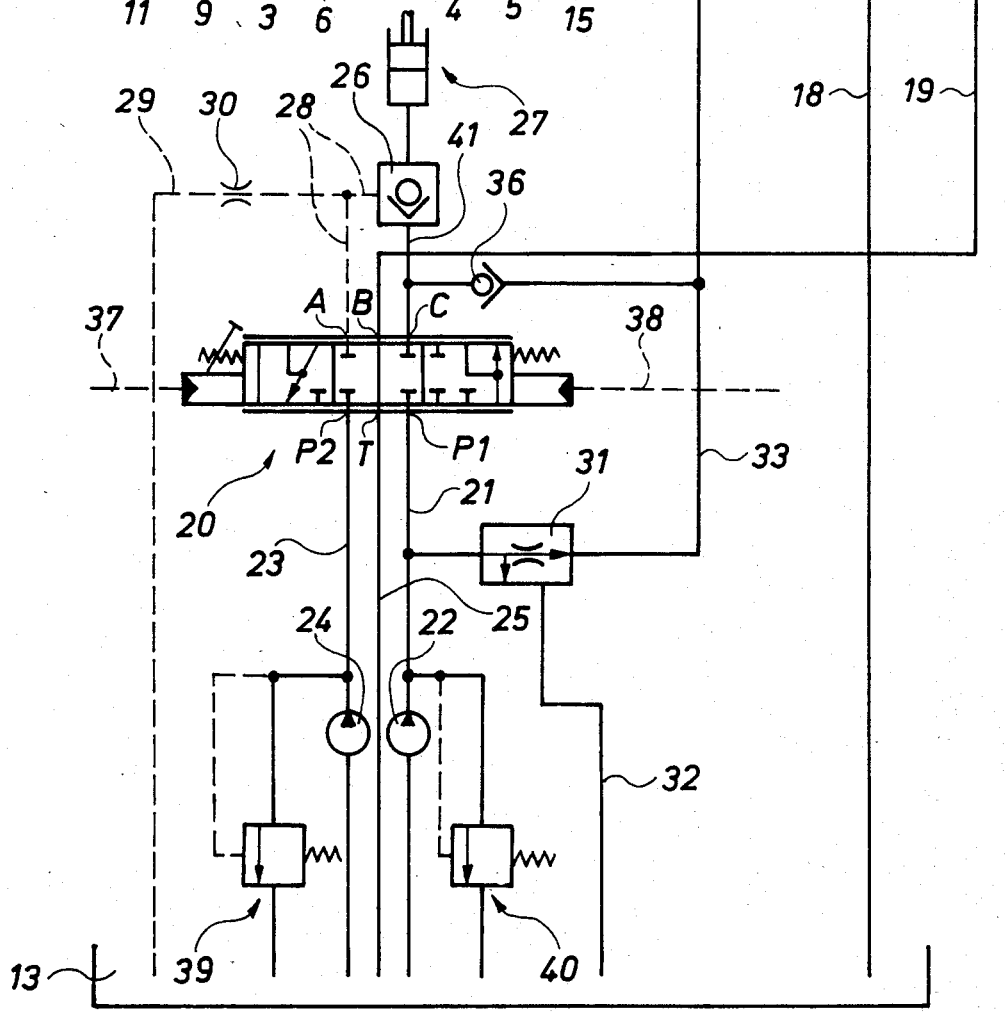
FIG. 2 is a switch diagram of a hydraulic or pneumatic system in which the control valve of FIG. 1 is arranged.

With reference to FIG. 2 it will be seen that the connection bore 14 of the valve is connected to the fluid supply container 13 via a conduit 18. The connection bore 15 is a control bore and is connected via a conduit 19 to a connection B of a three-position six-way proportional valve 20, the connection P1 of which is in turn connected with a first pressure medium source, namely pump 22, via a conduit 21. Connection P2 of the proportional valve 20 is connected with a second pressure medium source, namely second pump 24, through a conduit 23, and connection T of valve 20 is associated with the fluid supply container 13 through a conduit 25. A further connection C of the proportional valve 20 is in turn connected to a controllable check valve 26 via a conduit 41; valve 26 being connected to a working cylinder 27. The check valve 26 opens in the direction of working cylinder 27. A control line or conduit 28 serves the purpose of controlling the check valve 26 and is connected to connection A of valve 20. The control line 28 is also connected with the fluid supply container 13 through a conduit line 29 in which a throttle device 30 is arranged.

A pressure compensator 31 is interconnected between the conduit 21 and conduit 33 leading to the transversal bore 11 of the control valve 17. In addition, a conduit 32 leads from the pressure compensator 31 to the fluid supply container 13. Conduit 33 is also connected to a control device 34 and connection 35 of valve 17. A check valve 36 openable in the direction of conduit 41 leading to the check valve 26 is interconnected between conduit 33 and connection C of the proportional valve 20. The control members of proportional valve 20 are respectively connected to control conduits 37 and 38 which serve for operating of the proportional valve 20 by means of the control device not illustrated in the drawings. A pressure limiting valve 39 is arranged in conduit 23 in parallel with the pump 24 and a pressure limiting valve 40 is placed in parallel with pump 22 in conduit 21.

In the control position of proportional valve 20 shown in FIG. 2 only connection B and connection T are connected to each other, which means that the connection bore 15 is connected with the fluid supply container 13. Pump 22 conveys pressure medium through the pressure compensator 31 and conduit 32 to the fluid supply container 13. The pressure compensator 31 is provided with a throttle through which pressure medium flows from pump 22 to conduit 33 and then to the control device 34, which means through bores 11 and 10 into valve 17 at the front face of the valve member 3; this pressure medium holds the valve member 3 in its one end position (right position in the plane of the drawing) in which bore 14, with which the fluid supply container 13 via conduit 18 is connected, is opened and the position of valve member 3 is completely distant from the bore 14.

If now the control member of proportional valve 20 is displaced from the right to the left connections B and C will be connected to connection P1 of valve 20 and the connection bore 15 of valve 17 and at the same time the working cylinder 27 will be connected with pump 22. Thereby the valve member 3 of valve 17 (FIG. 1) will be moved to the left and take its end position as shown in FIG. 1. The pressure compensator 31 closes its connection to the conduit 32 leading to fluid supply container 13. The pump pressure is transmitted to the control device 34 and connection 35, e.g. to the transversal bore 11 of valve 17. Since the axial bore 10 is of the diameter substantially smaller than the diameter of piston 4 the seat portion 8 remains against the valve seat 9 and the connection of conduit 33 with conduit 18 is blocked. When seat portion 8 is positioned against valve seat 9 the leaking pressure medium can flow through the throttle opening formed in the region of contact of piston 4 and connection bore 1.

The valve 17 opens when the pressure in the control bore 15 is substantially reduced, which means that when the control member of the proportional valve 20 is displaced to the right (in the plane of the drawing) connections B and C become connected with the connection T. As soon as seat portion 8 of valve member 3 is lifted from the valve seat 9 a force acting in a shock-like manner against the piston 4 at its side facing toward the seat portion 8 is exerted in the valve, which force is such that the valve member 3 opens in the shock-like manner and is displaced to its end position which is its right position in the drawing. The action of that force is increased as the throttle portion 6 initially overlaps and covers the connection bore 14. Valve member 3 therefore takes only two stable end positions. Pump 22 again conveys the pressure medium through the pressure compensator 31 and conduit 32 to the fluid supply container 13 and pressure in conduit 33 prevails so that valve member 3 is maintained in its lifted position.

Valve 17 serves for controlling the pressure compensator 31. Its purpose, in fact, is to avoid an undetermined pressure condition of pump 22, for example if the control member of proportional valve 20 is in its middle position, the pump pressure has a value lying between the load pressure exerted in the working cylinder 27 and the circulation pressure of pump 22.

When connections T, B and C of valve 20 are connected to each other the connection between A and P2 also takes place; the latter makes the connection of working cylinder 27 with control pump 24 during the lowering of the piston in the working cylinder 27. Only during the lowering of the piston of the working cylinder 27 does a pressure medium loss occur also through the throttle device 30. In the device of the present invention liquid as well as gas can be utilized as a pressure medium.

Figure 3:
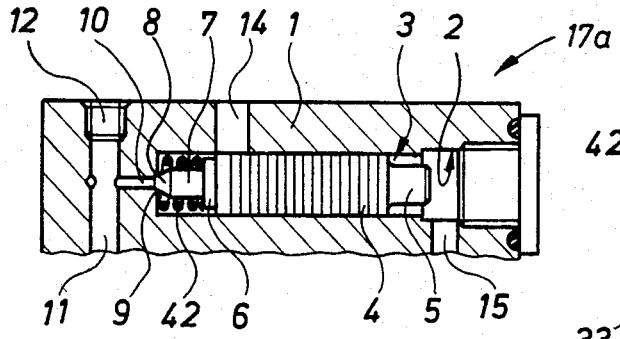
FIG. 3 is an axial sectional view of the valve according to a second embodiment of the invention.
Figure 4:
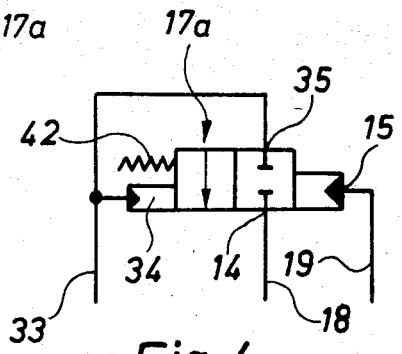
FIG. 4 is a schematic view of the valve of FIG. 3.

FIG. 3 illustrates another embodiment of the control valve which is denoted in FIGS. 3 and 4 as 17*a*. In this embodiment the valve member 3 is provided with a spring 42 working in opening sense, which spring is inserted between the front wall forming the pocket opening 2 and the face of the throttle portion 6 of valve member 3. Spring 42 reliably holds valve member 3 in its open end position. FIG. 4 depicts a diagrammatic view of the valve 17*a* with spring 42.

Figure 5:
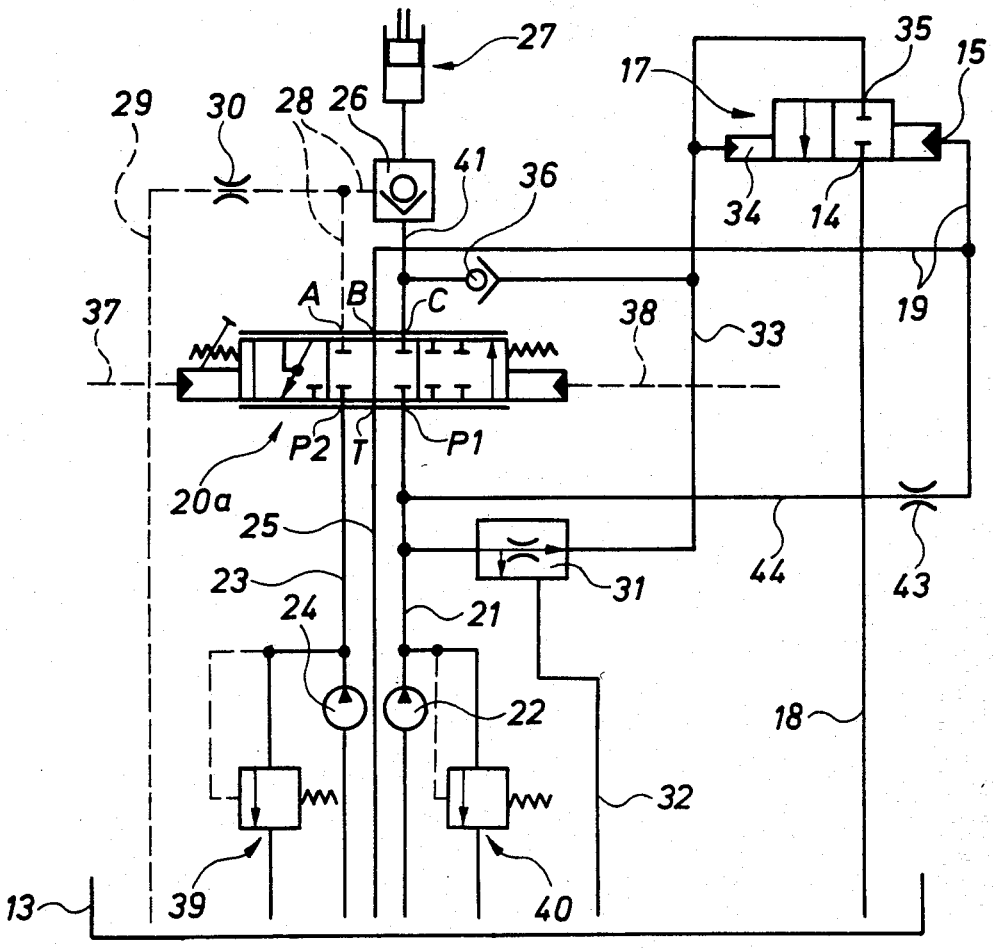
FIG. 5 is a switch diagram of the modified hydraulic or pneumatic system with the control valve of the invention installed therein.

With reference to FIG. 5 it will be seen that the proportional valve is identified as 20*a* in this embodiment. When the control member of valve 20*a* is displaced to the left from its middle position only connection C is connected with connection P1; this control member operates in the manner similar to the control member of valve 20 shown in FIG. 2 but is simpler than the control member of valve 20. In the embodiment of FIG. 5 a throttle device 43 is arranged in a conduit 44 connected between conduit 21 and conduit 19 leading to the bore 15. When the connection bore 15 is connected through conduit 19 with the fluid supply container 13 the pressure medium flowing through the throttle device 43 to bore 15 will release a prevailing pressure in the fluid supply container 13.

Figure 6:
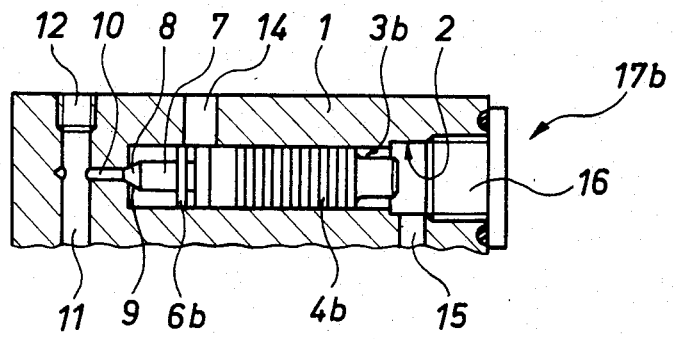
FIG. 6 is an axial sectional view of still another embodiment of the control valve.
Figure 7:
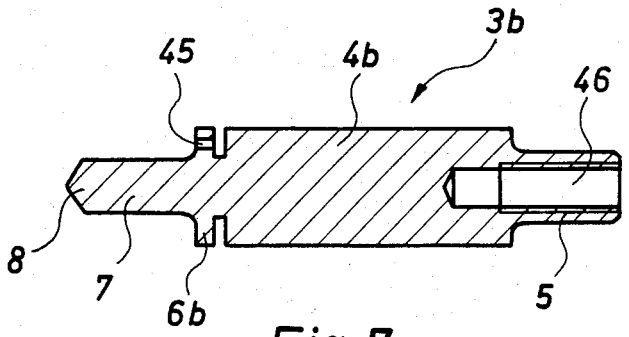
FIG. 7 is an enlarged sectional view of the piston of the valve of FIG. 6.
Figure 8:
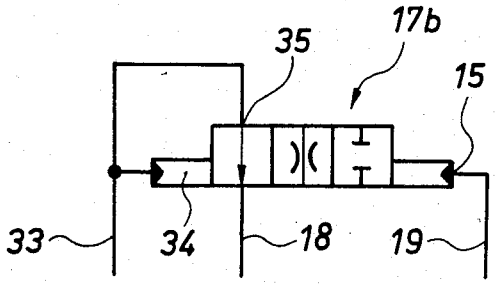
FIG. 8 is a schematic view of the valve of FIG. 6.

In the embodiments shown in FIGS. 6 and 7 the throttle portion 6 of the valve member denoted here as 3*b* is formed with a collar 6*b* which has the outer diameter equal to that of piston 4*b* and is provided at the distance from the front face of piston 4*b*. A throttle bore 45 is formed in the collar 6*b*. Piston 4*b* is provided at the side thereof opposite to the seat portion 8 with a threaded bore 46 which is used for insertion thereinto of a tool required for removal of the valve member 3*b* from the valve housing 1 after the screw 16 is taken off from the opening at the end of housing 1.

In the closed position of the valve member 3*b* its seat portion 8 abuts against the valve seat 9 and the connection between the transversal bore 11 and connection bore 14 leading to fluid supply container 13 is closed. When the valve member 3*b* starts opening the axial bore 10, the pressure medium acts upon the collar 6*b* and only a small quantity of the pressure medium can flow through the throttle bore 45 and connection bore 14 into the fluid supply container 13 so that the valve member 3*b* further opens in an impact-like manner until collar 6*b* has sufficiently opened the connection bore 14. Due to a required selection of the ratio between the surfaces of the throttle devices in the pressure compensator 31 and in collar 6*b* a switching manner of the valve member 3*b* can be adjusted to the required conditions of operation.

The advantage of the valve member 3*b* as compared to valve member 3 of FIGS. 1 and 3 is that it is less expensive in manufacturing because due to the fact that collar 6*b* is of the same diameter as piston 4*b* they can be produced in one grinding process whereas for making piston 4 with the throttle portion 6 two grinding steps are required. The throttle bore 45 can be also produced in collar 6*b* in inexpensive manner. The provision of the throttle means in collar 6*b* with small allowances is important because diameter variations of throttle bore 45 and throttle portion 6 strongly affect the switching abilities of the device.

It will be understood that each of the elements described above, or two or more together, may also find a useful application in other types of devices for controlling the connection between a pressure medium source and a fluid supply container differing from the types described above.

While the invention has been illustrated and described as embodied in a device for controlling the connection between a pressure medium source and a fluid supply container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for controlling a connection between a pressure medium source and a pressure medium supply container in a pressure medium operated system, comprising a control valve including a valve housing; a valve member having an axis, said valve member being axially displaceable in said housing by pressure of said medium, said housing having a valve seat, said valve member being formed with a piston and a seat portion projecting outwardly from said piston and facing said valve seat, said piston being of a diameter larger than a diameter of the valve seat, said housing being formed with a connection bore connected to the supply container and provided at the side of said piston facing towards said seat portion, said piston during its displacement controlling an opening and a closing of said bore, said valve member at the side thereof facing away from said seat portion being loaded with the pressure medium by selection; and a throttle means provided at a side of said piston facing toward said seat portion, said valve member being displaceable between two end positions, said seat portion abutting against said seat valve in one of said end positions, said piston limiting a pressure medium flow from said connection bore in a throttling manner, said housing in the region of said valve member at the side thereof facing from said seat portion being formed with an inlet bore for receiving pressure medium into said housing, said inlet bore being connected with the pressure medium source or the supply container by selection.

2. The device as defined in claim 1, wherein said throttle means is formed between a projection provided on said valve member and extended between said seat portion and said piston and a wall of said housing, said projection being of a diameter smaller than that of said piston.

3. A device as defined in claim 1, wherein said valve member is formed with a collar arranged between said seat portion and said piston and spaced therefrom in the axial direction, said throttle means being formed by a throttle opening provided in said collar, said collar being of a diameter equal to that of said piston.

4. The device as defined in claim 1, further including a switchable pressure compensator arranged in the pressure medium operated system and interconnected between the pressure medium source and said housing in the region of said valve seat to convey the pressure medium to the side of the valve member facing said valve seat.

5. The device as defined in claim 1, further including a spring clamped between said valve seat and said piston.

6. The device as defined in claim 1, further including additional throttle means arranged in the pressure medium operated system, said additional throttle means being interconnected between said pressure medium source and said inlet bore in said housing, whereby said side of the valve member facing away from said seat portion is constantly connected to the pressure medium source through said additional throttle means.

7. The device as defined in claim 1, wherein said valve member is formed with a threaded bore at the side of the valve member facing away from said seat portion.

8. A device for controlling a connection between a pressure medium source and a pressure medium supply container in a pressure medium operated system, comprising a control valve including a valve housing; a valve member having an axis, said valve member being axially displaceable in said housing by pressure of said medium, said housing having a valve seat, said valve member being formed with a piston and a seat portion projecting outwardly from said piston and facing said valve seat, said piston being of a diameter larger than a diameter of the valve seat, said housing being formed with a connection bore connected to the supply container and provided at the side of said piston facing towards said seat portion, said piston during its displacement controlling an opening and a closing of said bore, said valve member at the side thereof facing away from said seat portion being loaded with the pressure medium by selection; and a throttle means provided at a side of the piston facing toward said seat portion; said valve member being formed with a collar arranged between said seat portion and said piston and spaced therefrom in the axial direction, said throttle means being formed by a throttle opening provided in said collar, said collar being of a diameter equal to that of said piston.

* * * * *